US008875993B2

(12) United States Patent
Dietz

(10) Patent No.: US 8,875,993 B2
(45) Date of Patent: Nov. 4, 2014

(54) APPARATUS FOR TEMPORARILY STORING AT LEAST ONE BANKNOTE TRANSPORT CONTAINER

(75) Inventor: Oliver Dietz, Borchen (DE)

(73) Assignee: Wincor Nixdorf International GmbH (DE)

( * ) Notice: Subject to any disclaimer, the term of this patent is extended or adjusted under 35 U.S.C. 154(b) by 82 days.

(21) Appl. No.: 13/696,212

(22) PCT Filed: May 5, 2011

(86) PCT No.: PCT/EP2011/057222

§ 371 (c)(1), (2), (4) Date: Nov. 5, 2012

(87) PCT Pub. No.: WO2011/138407

PCT Pub. Date: Nov. 10, 2011

(65) Prior Publication Data

US 2013/0055931 A1 Mar. 7, 2013

(30) Foreign Application Priority Data

May 5, 2010 (DE) ..... 10 2010 016 810

(51) Int. Cl.
*G07D 11/00* (2006.01)
*G07F 7/04* (2006.01)

(52) U.S. Cl.
CPC ..... *G07D 11/0009* (2013.01)
USPC ..... 235/379; 194/206

(58) Field of Classification Search
CPC . G07F 19/20; G07F 19/1202; G07D 11/0021; G07D 11/0084; G07D 11/0006; G07D 11/0012; G07D 11/006; G07D 7/00; B65H 2701/1912
USPC ..... 235/379; 194/202, 206, 207; 902/7; 382/135, 137; 209/534
See application file for complete search history.

(56) References Cited

U.S. PATENT DOCUMENTS 5,450,937 A * 9/1995 Ono et al. ..... 194/203
7,696,871 B2 4/2010 Villiger (Continued)

FOREIGN PATENT DOCUMENTS

DE 102007014176 A1 8/2008
DE 102008045607 A1 3/2010

(Continued)

OTHER PUBLICATIONS

International Preliminary Report on Patentability for PCT/EP2011/057222 mailed Nov. 15, 2012 with English translation (21 pages).

(Continued)

*Primary Examiner* — Jamara Franklin
(74) *Attorney, Agent, or Firm* — Harness, Dickey & Pierce, P.L.C.

(57) ABSTRACT

An apparatus for storing a bill transport container. The apparatus includes a holding compartment for holding the bill transport container. The bill transport container includes a cancellation unit for invalidating bills that are held and a control unit having a timer that triggers the cancellation unit after a preset time interval. A control unit of the apparatus and the control unit of the bill transport container can have a data transmission link set up between them when the bill transport container is held in the holding compartment. This link can be used to transmit data for setting the timer of the control unit. A bill transport container is included in which in a first mode of operation the control unit triggers the cancellation unit after a first preset time interval and in a second mode of operation it triggers the cancellation unit after a second preset time interval.

21 Claims, 2 Drawing Sheets

(56) References Cited

U.S. PATENT DOCUMENTS

| | | | | |
|---|---|---|---|---|
| 8,267,398 | B2 * | 9/2012 | Takada et al. | 271/198 |
| 2007/0229258 | A1 | 10/2007 | Villiger | |
| 2010/0117844 | A1 | 5/2010 | Brexel et al. | |
| 2011/0155026 | A1 | 6/2011 | Villiger | |
| 2011/0181416 | A1 | 7/2011 | Dietz et al. | |

FOREIGN PATENT DOCUMENTS

| | | | |
|---|---|---|---|
| EP | 0235103 | A2 | 9/1987 |
| EP | 1082514 | A1 | 3/2001 |
| EP | 1566513 | A2 | 8/2005 |
| EP | 1843000 | A2 | 10/2007 |
| EP | 2031567 | A2 | 3/2009 |
| GB | 2280056 | A | 1/1995 |
| WO | WO-99-58799 | A1 | 11/1999 |
| WO | WO-2006-041358 | A1 | 4/2006 |
| WO | WO-2006-125796 | A1 | 11/2006 |
| WO | WO-2007-014803 | A1 | 2/2007 |
| WO | WO-2008-092754 | A1 | 8/2008 |

OTHER PUBLICATIONS

International Search Report (in German with English translation) and Written Opinion (in German) for PCT/EP2011/057222, mailed Aug. 9, 2011; ISA/EP.

* cited by examiner

APPARATUS FOR TEMPORARILY STORING AT LEAST ONE BANKNOTE TRANSPORT CONTAINER

CROSS-REFERENCE TO RELATED APPLICATIONS

This application is a National Stage of International Application No. PCT/EP2011/057222, filed May 5, 2011, and published in German as WO 2011/138407 A1 on Nov. 10, 2011. This application claims the benefit and priority of German Application No. 10 2010 016 810.6, filed May 5, 2010. The entire disclosures of the above applications are incorporated herein by reference.

BACKGROUND

This section provides background information related to the present disclosure which is not necessarily prior art.

TECHNICAL FIELD

The invention relates to an apparatus for temporarily storing at least one bill transport container. The apparatus comprises at least one holding compartment for holding the bill transport container. The bill transport container in turn comprises a cancellation unit for invalidating bills held in the bill transport container and a control unit having a timer which automatically triggers the cancellation unit after a preset time interval. A further aspect of the invention relates to a bill transport container which comprises a cancellation unit for invalidating bills which it holds and a control unit having a timer.

DISCUSSION

The document WO 2007 014803 A1 discloses a system for inserting and dispensing bills comprising various devices such as a payment station and an automatic teller machine. A transfer unit having a bill transport device and a bill storage device is provided into which the banknotes can be inserted, stored and dispensed again.

The document WO 2006 041 358 A1 discloses a system for handling banknotes for retail. For holding banknotes, a cash box having a drum module is provided, wherein the cash box comprises a timer for triggering an ink kit.

The document EP 2 031 567 A2 discloses a system for a closed cash logistics chain. The system comprises a plurality of cash stations and a cash office having a checkout safe which comprises a docking station for interchangeable banknote containers from the cash stations.

The document WO 2008 092 754 A1 discloses a value transport vehicle having a shelf system for holding value transport containers.

In order to increase security, bill transport containers are provided with timers which automatically trigger a cancellation unit arranged in the container after a preset time interval. One problem with the use of such timers is that if delays occur during the transport of the bill transport container, the timer reaches the trigger value and therefore the cancellation unit is triggered to invalidate the bills held in the bill transport container even though there is no manipulation attempt. In this case, the bills are cancelled unnecessarily, which unnecessarily incurs costs and effort. Such unnecessary triggering of the cancellation unit is also called mistriggering.

SUMMARY OF THE INVENTION

It is an object of the invention to specify an apparatus for temporarily storing at least one bill transport container and a bill transport container which reduce the number of mistriggering operations on a cancellation unit for bill transport containers.

The setup of a data transmission link between a control unit of the apparatus and the control unit of a bill transport container held in the holding compartment of the apparatus and the transmission of data for setting the timer via this data transmission link from the control unit of the apparatus to the control unit of the bill transport container achieves the effect that the timer can be set in line with the respective requirements when the bill transport container is temporarily stored in the apparatus. This reduces the number of mistriggering operations on the cancellation unit. The setting of the timer can be understood to mean either stopping the timer, setting the timer to a new time interval or allowing the timer to continue to run without alteration. The timer is allowed to continue to run without alteration particularly when the control unit has ascertained the remaining time still left on the timer and has compared it with a preset limit value, and the result of the comparison is that the remaining time is above the limit value. The effect achieved by stopping the timer or by setting a new time interval is that the timer does not continue to count down, or a new time interval is started, when the bill transport container is held in the apparatus, with the result that the cancellation unit is prevented from being triggered in the event of delays in the transport of the value transport container as a result of temporary storage in the apparatus.

The apparatus preferably comprises a plurality of holding compartments which are each able to hold at least one bill transport container. The effect achieved by this is that the apparatus is simultaneously able to hold a plurality of bill transport containers. To this end, the apparatus comprises particularly a bay in the form of a rack, which can be used to hold and temporarily store a multiplicity of bill transport containers.

The data transmission link can be set up either wirelessly or in wired fashion. In the case of a wired data transmission link, the data transmission is effected particularly by means of a plug connection which is made between a plug connector on the apparatus and a plug connector on the bill transport container when the bill transport container is held in a holding compartment of the apparatus. The effect achieved by such a plug connection is that secure, reliable data transmission is ensured and that manipulation attempts during the transmission of data are hampered.

In one preferred embodiment of the invention, the control unit of the apparatus stops the timer when the bill transport container is inserted into the holding compartment and restarts the timer with the remaining time which the timer still had upon insertion when the bill transport container is removed from the holding compartment again. The effect achieved by this is that the timer is stopped for the time for which the bill transport container is temporarily stored in the apparatus and continues to count only upon removal. Hence, the total time available for transport is the same as the preset time interval, but this time interval is interrupted during temporary storage, with the result that premature unnecessary triggering of the cancellation unit is avoided.

In one alternative embodiment of the invention, the control unit can also deactivate the timer when the bill transport container is inserted into the holding compartment and can restart it with the preset time interval when said bill transport container is removed from the holding compartment. In particular, deactivation of the timer is understood to mean that the timer cannot result in triggering of the cancellation unit while the bill transport container is held in the holding compartment, regardless of what value said timer has. The effect achieved by starting the timer with the preset time interval following removal from the holding compartment is that the same time interval as previously for transport to the apparatus for temporary storage is again available for the further transport without the cancellation unit being triggered.

In a further alternative embodiment of the invention, the control unit can deactivate the timer when the bill transport container is inserted into the holding compartment and can restart the timer with a further time interval, which is different than the preset time interval, when said bill transport container is removed from the holding compartment. The value of this new further time interval is dependent particularly on the respective location to which the bill transport container is intended to be transported following removal from the apparatus. The effect achieved by this is that, depending on the distance to be covered during transport, a suitable time interval is set which is firstly not chosen to be too short, with the result that the probability of the cancellation unit being triggered by the timer is high, but is secondly also not chosen to be too long, so that the manipulation attempt is forestalled.

In addition, it is advantageous if the control unit of the apparatus sets a mode of operation for the bill transport container when the bill transport container is held in the holding compartment. In this case, the control unit particularly sets an activated mode of operation, in which the control unit triggers the cancellation unit when the manipulation sensor has detected a manipulation attempt, or a deactivated mode of operation, in which the control unit does not trigger the cancellation unit when the manipulation sensor has detected a manipulation attempt. The effect achieved by this is that the control unit of the apparatus sets a mode of operation which is suitable for the respective conditions of temporary storage in the apparatus. The effect achieved by setting the activated mode of operation is particularly that the apparatus does not need to be in the form of a safe, since manipulation attempts are forestalled or manipulation attempts are prevented in the activated mode of operation even without the bill transport container being protected by a safe. This makes it possible to dispense with a safe, which saves effort and costs.

The apparatus is arranged particularly in a vehicle, preferably a value transport vehicle. The effect achieved by the timer and the mode of the operation of the bill transport container being set by the apparatus held in the vehicle is that it is possible to dispense with armoring the vehicle or storing the bill transport container in a safe within the vehicle, since the bill transport container is adequately protected by the translation unit and the appropriate sensor system. In addition, the data transmission link can be used to transmit logistics data between the apparatus and the bill transport container while the bill transport container is held in the holding compartment, with the result that it is possible to dispense particularly with written entry of logistics data on dockets arranged on the bill transport container, or enclosed dockets, during transport. This reduces the effort and minimizes the susceptibility to error.

In addition, the apparatus may also be arranged at a fixed location in a building. In this case too, this apparatus makes it possible to dispense with a safe for temporarily storing the bill transport containers. The apparatus is arranged particularly in what is known as a back office, in which bill transport containers removed from automatic checkouts are emptied and/or filled. In addition, the apparatus may also be arranged in what is known as a cash center. A cash center is understood to mean particularly a central location at which cash boxes are emptied and/or filled.

In a further embodiment of the invention, the apparatus is designed such that it is manually portable. In this context, manually portable is understood to mean that the apparatus can be transported from a place of origin to a destination by a person. To this end, the apparatus is designed particularly such that it weighs no more than 25 kg, in particular has a weight in the range between 3 kg and 25 kg.

The data transmission link is used to transmit particularly data having information about the stock of bills in the bill transport container, manipulation attempts, the place of origin of the bill transport container, the destination of the bill transport container, handover locations for the bill transport container and/or handover times for the bill transport container. The effect achieved by this is that this information does not need to be transmitted manually by means of appropriate dockets or does not need to be input manually into memory elements of the bill transport container. This reduces the effort and the susceptibility to error.

A further aspect of the invention relates to a bill transport container in which in a first mode of operation the control unit triggers the cancellation unit after a first preset time interval and in a second mode of operation the control unit triggers the cancellation unit after a second preset time interval. A memory area of the memory element of the bill transport container stores origin data having information about the last two apparatuses for handling bills which held the bill transport container. The control unit sets the mode of operation on the basis of these origin data. This provides an intelligent bill transport container in which the control unit uses the origin data to set the respective optimum mode of operation automatically itself without the need for the mode of operation to be set externally, for example manually or via a data transmission link formed between the bill transport container and an apparatus for handling bills. The two modes of operation are different modes of operation, in particular, the first mode of operation having a short time interval set, which is used to transport the bill transport container over short distances, and the second mode of operation having a long time interval—in comparison with the first time interval—set, which is intended for transporting the bill transport container over long distances.

It is advantageous if a memory area of the memory element stores destination data having information about the apparatus for handling bills to which the bill transport container is intended to be transported next and if the control unit sets the mode of operation on the basis of these destination data. The effect achieved by this is that not only the origin data but also destination data are taken into consideration for selecting the optimum mode of operation. As already mentioned, the temporary store may be a mobile interim storage facility, this preferably being arranged in a vehicle.

At least one of the two apparatuses for handling bills may be one of the previously described apparatuses for temporarily storing bill transport containers. The storage of data having information about the bill transport container being held in this temporary store and in that apparatus which held the bill transport container before the temporary store allows the control unit to ascertain the destination to which the bill transport container is intended to be transported next, with the result that the optimum transport mode can be set without destination data being available.

In addition, it is advantageous if the control unit sets a third mode of operation when the bill transport container is arranged in an automated teller machine, an automatic checkout safe and/or an automatic checkout system. In this third mode of operation, the control unit triggers the cancellation unit when a manipulation attempt has been detected by a manipulation sensor unit. The manipulation sensor unit may comprise an acceleration sensor, a displacement sensor, a shock sensor, a liquid sensor, a gas sensor and/or a sensor for detecting an opening in a lid of the bill transport container. If the bill transport container is arranged in an automated teller machine, an automatic checkout safe or an automatic checkout system, triggering of the manipulation sensor unit prompts the assumption that there is a manipulation attempt and hence the cancellation unit is triggered.

The bill transport container is particularly in the form of a cash box, which hampers unauthorized access to the bills. The cash box may comprise either a drum module, which stores the bills in wound-up form, or a holding compartment, which stores the bill in stacked form.

A further aspect relates to an arrangement for handling bills which comprises an apparatus for temporarily storing at least one bill transport container as described previously, wherein the holding compartment of the apparatus holds a bill transport container as described previously.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention can be found in the description below, which explains the invention in more detail with reference to exemplary embodiments in conjunction with the enclosed figures, in which.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
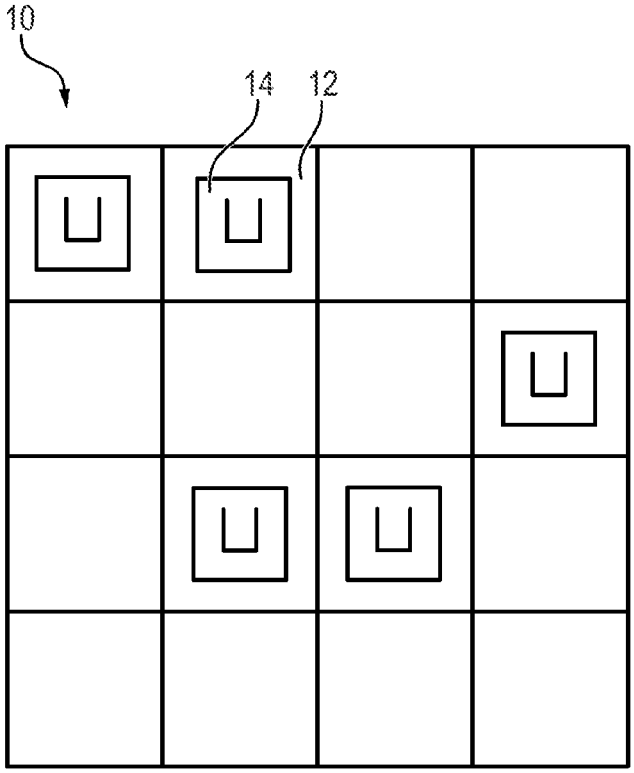
FIG. 1 shows a schematic illustration of an apparatus for temporarily storing bill transport containers.

FIG. 1 shows a schematic illustration of an apparatus in the form of a rack 10 for temporarily storing bill transport containers. The rack 10 comprises a multiplicity of holding compartments for holding a respective bill transport container, one of these holding compartments being denoted by way of example by the reference symbol 12 and one of these bill transport containers being denoted by way of example by the reference symbol 14.

The bill transport container 14 is particularly in the form of a cash box which holds the bills to be stored and protects them against unauthorized access operations. For the purpose of storing the bills, the cash box may comprise a drum module and/or at least one holding compartment for storing the bills in stacked form. In addition, the cash box 14 comprises a cancellation unit for automatically invalidating the bills stored in it in the case of a detected manipulation attempt. The cancellation unit is particularly in the form of an ink kit which irreversibly dyes the stored bills with a dye in the event of a manipulation attempt, so that a potential thief is no longer able to put them into cash circulation.

In addition, the bill transport container 14 comprises a control unit for controlling the cancellation unit which actuates the cancellation unit, particularly for triggering purposes. Triggering of the cancellation unit is understood to mean that the cancellation unit is used to invalidate the stored bills. The control unit comprises a timer which counts down a preset time interval or counts up to a preset value. When the preset time interval has elapsed, the control unit triggers the cancellation unit in an activated mode of operation. The intended effect achieved by this, particularly when the bill transport container is transported between an automated teller machine, an automatic checkout system, an automatic checkout safe, an interim store 10, a cash center or a back office, is that if the transport takes an unusually long time, for example because the service employee transporting the bill transport container 14 is attacked, the bills held in the bill transport container 14 are cancelled and therefore cannot be used by the perpetrator who carries out the attack. This is intended to forestall manipulation attempts from the outset.

In a deactivated mode of operation, on the other hand, the control unit does not trigger the cancellation unit, even if the timer has elapsed. Alternatively, the timer can also be deactivated in the deactivated mode of operation, so that no time-interval-dependent triggering at all takes place. To this end, the timer is repeatedly reset to the preset time interval, particularly at short intervals. If the bill transport container 14 is arranged in the holding compartment 12 of the rack 10 for temporary storage, the bill transport container 14 and the rack 10 have a data transmission link formed between them. This data transmission link can be used to transmit particularly data between the control unit of the bill transport container and a control unit—not shown—of the rack 10. The data transmission link may be either in wireless form or in wired form. In one preferred embodiment of the invention, the data transmission is effected via a plug connection formed between a plug connector on the rack 10 and a plug connector on the bill transport container 14. To this end, particularly that plug connector on the bill transport container 14 is used which is also used for the data transmission between the bill transport container 14 and an automated teller machine, an automatic checkout system and/or an automatic checkout safe when the bill transport container 14 has been inserted into the appropriate apparatus. The effect achieved by this is that it is not necessary to provide a separate connector for the data transmission between the bill transport container 14 and the rack 10, as a result of which a simple, inexpensive design of the bill transport container 14 is achieved.

The data transmission link can be used to transmit data for setting the timer from the control unit of the rack 10 to the control unit of the bill transport container 14. Setting of the timer may be either stopping the timer, setting the timer to a new time interval or allowing the timer to continue to run unaltered. In one preferred embodiment of the invention, the timer is stopped as soon as the bill transport container 14 has been inserted into the rack 10. When the bill transport container 14 is removed from the holding compartment 12 again, the timer continues to run or is restarted with a new time interval. The effect achieved by this is that the timer does not continue to run while the bill transport container 14 is temporarily stored in the rack 10, and hence unnecessary triggering of the cancellation unit is avoided.

In addition to the data having information about the setting of the timer of the control unit of the bill transport container 14, which data are used to set the timer when the bill transport container 14 is held in the rack 10, the data transmission link can also be used to transmit further data. In particular, the control unit of the rack 10 can set a mode of operation for the bill transport container 14 in this manner. The bill transport container 14 can therefore be changed over particularly between the activated mode of operation and the deactivated mode of operation. In addition, the bill transport container 14 can be put into a special interim storage mode, into which the bill transport container 14 has been put when it is held in a rack 10. In particular, various sensors for detecting a manipulation attempt, particularly acceleration sensors, shock sensors, displacement sensors, liquid sensors, gas sensors and/or sensors for detecting an opening in a lid of the bill transport container 14, are activated in this intermediate storage mode, with the result that they can be used to detect a manipulation attempt and, in the event of a manipulation attempt, the cancellation unit can be triggered. The effect achieved by this is that the rack 10 does not need to be protected in the manner of a safe, since manipulation while the bill transport container 14 is temporarily stored in the rack 10 is detected by the appropriate sensor system of the bill transport container 14 and is prevented by the cancellation unit.

Figure 2:
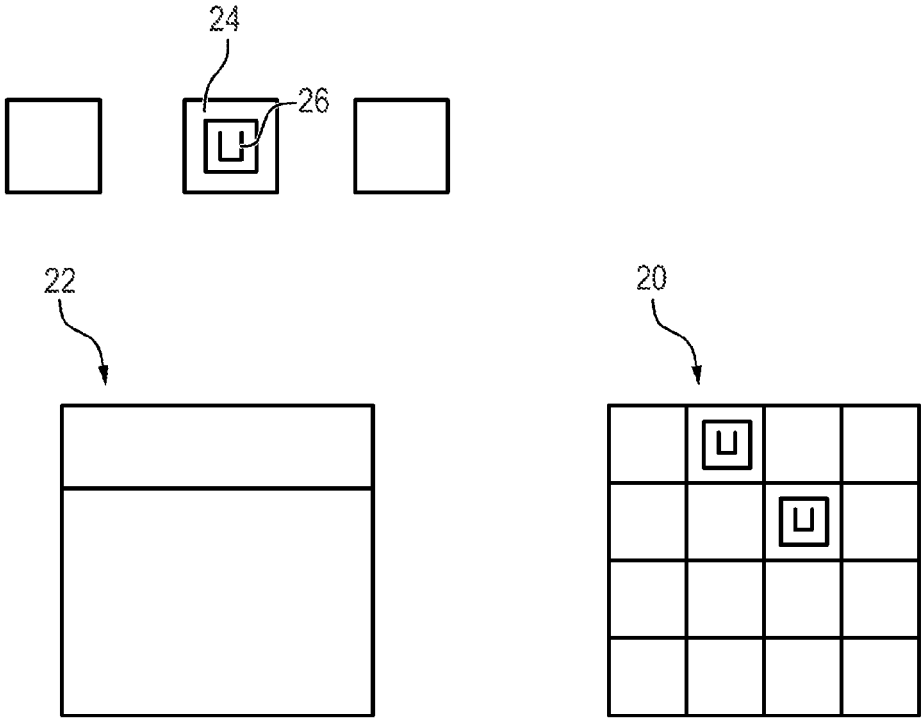
FIG. 2 shows a schematic illustration of a multiplicity of automatic checkout safes, a rack and a consolidator.

FIG. 2 shows a multiplicity of automatic checkout safes, a rack 20 and a consolidator 22. One of the automatic checkout safes is denoted by way of example by the reference symbol 24. The automatic checkout safes 24 can each hold at least one bill transport container 26, the bill transport container 26 in the example shown being in the form of a transportable drum module. When a transportable drum module 26 has been filled to the maximum level and/or at closing time, the drum modules 26 are removed from the automatic checkout safe 24 by the checkout staff and are transported to a back office, where they are emptied and possibly refilled with bills by means of what is known as a consolidator 22. At closing times, the checkout staff from the various automatic checkout safes 24 may all simultaneously remove the relevant drum modules 26 and transport them to the back office. During the transport of the drum module, the timer of the transportable drum module 26 is activated with a preset time interval, so that only the relevant time interval is available for transport to the consolidator 22. If the preset time interval is exceeded, i.e. the timer has reached the value "0" or another preset limit value, then the control unit triggers the cancellation unit and the bills held in the transportable drum module 26 are irreversibly dyed by the ink kit.

If a multiplicity of transportable drum modules 26 are transported to the back office simultaneously at closing times, a queue may arise in front of the consolidator 22, since only one transportable drum module 26 can be held in the consolidator 22 at a time. So that the cancellation units of the transportable drum modules 26 which are not yet held in the consolidator 22 are not triggered as a result of the respective timer expiring during this queue, even though there is not actually a manipulation attempt, the transportable drum modules 26 are temporarily stored in the rack 20. While the transportable drum modules 26 are temporarily stored in the rack 20, the control unit of the rack 20 stops the timers of the stored drum modules 26, so that these timers do not continue to run and cannot result in the cancellation unit being triggered. When a drum module 26 is removed from the rack 20 again, the timer automatically continues to run. Alternatively, when or shortly before the transportable drum module 26 is removed from the rack 20, the timer can also be restarted with a new preset time interval. To this end, a relatively short preset time interval is used, in particular, since transport between the rack 20 and the consolidator 22 usually does not require a large amount of time.

In addition to the data required for setting the timer, the data transmission link between the transportable drum module 26 and the rack 20 can also be used to transmit logistics data from the transportable drum module 26. In particular, the data transmission link can be used to transmit data having information about the number and value of all the bills held in the transportable drum module 26, about the apparatus which held the transportable drum module 26, or the last apparatuses which held the transportable drum module 26, and/or about the destination of the transportable drum module 26. These logistics data are transmitted particularly from the rack 20 to a central data processing unit, which is used to control and coordinate the cash management of a multiplicity of automatic checkout systems, automatic checkout safes, cash systems and/or bill transport devices.

In addition, the plug connection which is used to effect the data transmission, for example, can also be used to provide the supply of power to the drum module 26 by using the plug connection to transmit electric power. This increases the service interval for the transportable drum module. In particular, the service interval is the time interval in which a transportable drum module regularly needs to be supplied with electric power.

As already described, the control unit of the rack 20 can set various modes of operation for the transportable drum module 26. In particular, various modes of operation are provided while the transportable drum module 26 is held in the rack 20. By way of example, what is known as a night mode is provided, in which the sensors of the transportable drum module 26 are "armed" for detecting manipulation attempts, i.e. as soon as at least one of the sensors detects a manipulation attempt the ink kit is triggered. The effect achieved by this is that a transportable drum module 26 filled with bills can safely be mounted in the rack 20 overnight without the need for the rack 20 to be designed and protected in a similar manner to a safe. In a waiting mode, on the other hand, which is activated when the transportable drum module 26 is held in the rack 20 and is waiting only briefly to be able to be held in the consolidator 22 and emptied or refilled, the sensors are not "armed", since the transportable drum module 26 is not intended to be temporarily stored for a long time. This avoids mistriggering the ink kit of one or more of the drum modules 26 while transportable drum modules 26 are being brought to and removed from the rack 20, sometimes in a frenzy, at the close of checkouts.

In addition, the drum module 26 may comprise a GPS system and/or a GSM system, which can be used to ascertain the current location of the transportable drum module 26 at any time. The data transmission link formed between the rack 20 and the transportable drum module 26 can transmit particularly the location transmitted by means of the system to the central data processing unit.

In one alternative embodiment of the invention, instead of transportable drum modules 26 it is also possible to use cash boxes, in the case of which the bills are held in holding compartments in stacked form. Similarly, it is alternatively possible for the rack 20 not to store the transportable drum module 26 while it is waiting to be emptied in the consolidator 22, but rather for it to temporarily store said drum module overnight after it has been refilled too. Alternatively, the rack 20 can also be used in a cash center, in which cash boxes are filled and/or emptied, instead of in a back office. In this case, the rack 20 temporarily stores the cash boxes which have been removed from an automated teller machine and/or are intended to be supplied to an automated teller machine before or after they are emptied and/or filled. In this way, it is also possible for a cash center to dispense with complex and expensive safes, since such protection by means of safes can be dispensed with by virtue of the appropriate changeover of the different modes of operation using the rack 20 and the timer.

In one alternative embodiment of the invention, the rack 10, 20 for temporarily storing the bill transport containers 14, 26 may also be arranged in a vehicle, particularly a value transport vehicle. In this case, the rack 10, 20 held in the vehicle is used to retain the bill transport containers 14 during transport by means of the vehicle without this requiring the provision of a safe in the vehicle and/or the use of an armored vehicle in order to ensure the necessary security.

The data transmission link formed between the rack 10, 20 held in the vehicle and the bill transport container 14 held in the rack 10, 20 can transmit particularly all the logistic data accruing during transport of the bill transport container 14. In particular, this allows automatic documentation of the handover of the bill transport containers 14 from an apparatus to the vehicle or from a cash center or a back office to the vehicle. In this way, it is possible to dispense with manual written signing-off of handovers and scanning of one-dimensional or two-dimensional codings affixed to the bill transport container 14. In addition, it is possible to dispense with radio or infrared gates, which allow partially automated recording at the handover points. In this way, comprehensive simple planning and monitoring of the processes during cash management is achieved overall and outlay and costs are saved.

In a further alternative embodiment of the invention, the rack 10, 20 may be in a form such that it can be carried manually, i.e. by a person. To this end, the rack 10, 20 is in a form such that it weighs no more than 25 kilos with the bill transport container(s) 14 which it holds.

Figure 3:
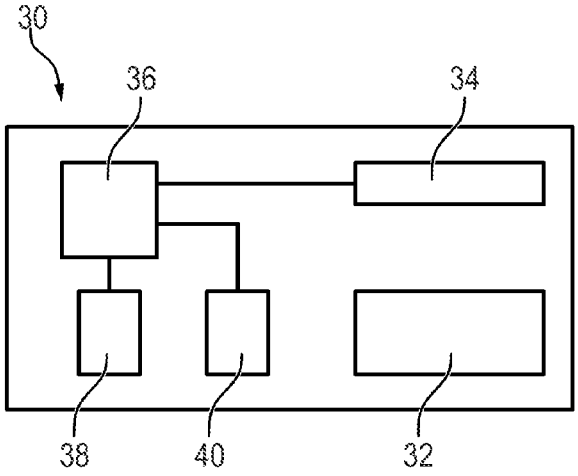
FIG. 3 shows a schematic illustration of a bill transport container.

FIG. 3 shows a schematic illustration of a bill transport container in the form of a cash box 30. The cash box 30 comprises a bill holding unit 32 which holds the bills to be transported and/or to be stored. The bill holding unit 32 may be either in the form of a drum module or in the form of a bill holding compartment, which holds the bills to be stored in stacked form. In addition, the cash box 30 comprises a cancellation unit 34 for irreversibly invalidating the bills held in the bill holding unit 32 and also a control unit 36 which triggers the cancellation unit 34.

In addition, the cash box 30 has a manipulation sensor unit 38 which can be used to detect manipulation attempts on the cash box 30. The manipulation sensor unit 38 may comprise a displacement sensor, an acceleration sensor, a shock sensor, a liquid sensor, a gas sensor and/or a sensor for detecting an opening in a lid—not shown—of the cash box 30.

Furthermore, the cash box 30 has a memory element 40 which stores at least origin data having information about at least in the last two apparatuses which held the cash box 30. In one preferred embodiment of the invention, the memory element 40 stores not only the last two apparatuses which held the cash box 30, but also the last n stations which held the cash box 30.

In addition, the memory element 40 stores data having information about various modes of operation which can be set by the control unit. In what is known as a safe mode, the manipulation sensor unit 38 is "armed", i.e. when the manipulation sensor unit 38 detects a manipulation attempt the control unit 36 triggers the cancellation unit 34. This safe mode is activated particularly when the cash box 30 is held in an automated teller machine, an automatic checkout system and/or an automatic checkout safe, and is therefore also called an ATM mode of operation.

In what is known as a rack mode of operation, the manipulation sensor unit 38 is likewise activated, with the result that upon the detection of a manipulation attempt the control unit 36 triggers the cancellation unit 34. This rack mode of operation is activated particularly when the cash box 30 is held in a rack 10, 20 for temporarily storing bill transport containers. By way of example, the rack mode of operation is different than the safe mode in that in the safe mode all the sensors of the manipulation sensor unit 38 are activated, whereas in the rack mode of operation the displacement and/or acceleration sensors of the manipulation sensor unit 38 are deactivated and only the other sensors of the manipulation sensor unit 38 are activated.

Furthermore, the control unit 36 can be operated in at least two transport modes, wherein in the first transport mode a timer of the control unit 36 is activated with a preset first time interval and in the second transport mode the timer of the control unit 36 is activated with a preset second time interval. In one preferred embodiment of the invention, more than two transport modes are provided, with each transport mode having a different time interval set for the timer and/or each transport mode having different sensors of the manipulation sensor unit 38 activated.

The control unit 36 sets the mode of operation of the cash box 30 on the basis of the origin data stored in the memory element 40. If, by way of example, the result of the origin data is that the cash box 30 was last held in a rack 20 for temporary storage and was previously held in an automatic checkout safe 24, the control unit 36 sets a transport mode with a short preset time interval, since the control unit ascertains from these origin data that the cash box 30 is next being transported to a consolidator 22.

The effect achieved by the respective mode of operation being set by the control unit 36 of the cash box 30 on the basis of the origin data stored in the memory element 40 is that the mode of operation does not have to be set externally, for example by virtue of data transmission between an apparatus which holds the cash box 30 and the cash box 30, but rather the control unit 36 autonomously sets in respective optimum mode of operation automatically. The cash box 30 is therefore also called an intelligent cash box. This reduces the effort for setting the correct mode of operation and also the susceptibility to error. In particular, it reduces the number of mistriggering operations on the cancellation unit 34, with the result that costs and effort are saved.

Figure 4:
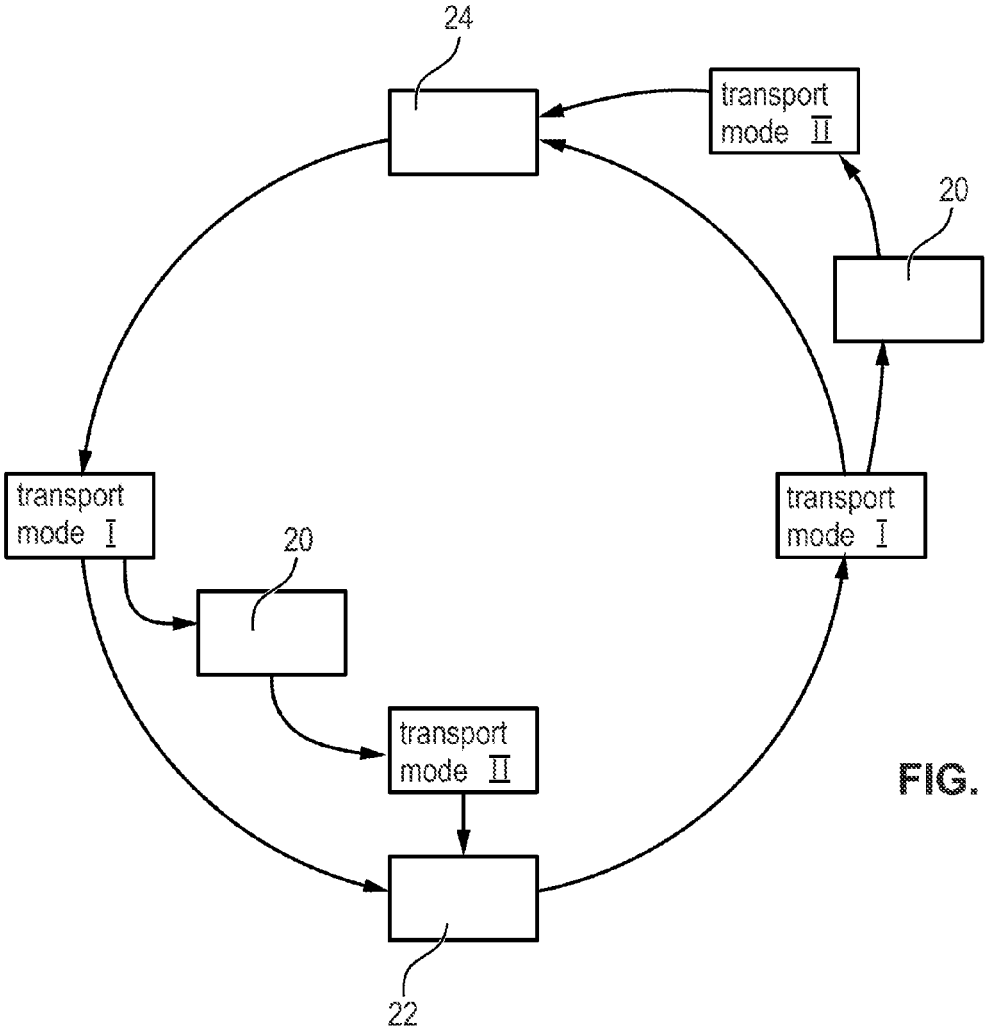
FIG. 4 shows a flowchart for the setting of the modes of operation of a bill transport container during transport of the bill transport container between various apparatuses for holding the bill transport container.

FIG. 4 shows a schematic simplified illustration of the setting of the various modes of operation of a bill transport container while held in a consolidator 22, a rack 20 and an automatic checkout safe 24 and also during transport between three apparatuses 20 to 24. When the bill transport container is removed from the automatic checkout safe 24, for example because the bill transport container is full or empty, the bill transport container is put into a first transport mode I by virtue of the timer of the control unit 36 having been set to a first time interval.

If the bill transport container is transported directly to the consolidator 22, the first transport mode I remains activated during the entire transport. Once the bill transport container is held in the consolidator 22, a deactivated mode of operation is activated in which the manipulation sensor unit 38 and the timer are deactivated, with the result that the cancellation unit 34 is not triggered by the control unit 36 while the bill transport container is filled and/or emptied in the consolidator 22. If the bill transport container is not transported directly to the consolidator 22, on the other hand, but rather is first temporarily stored in the rack 20, then the rack mode of operation described previously is activated during the temporary storage in the rack. Following removal from the rack 20 for transport to the consolidator 22, a second transport mode II is set, in which the timer has been set to a second preset time interval. The second preset time interval is shorter than the first preset time interval, since the transport path between the rack 20 and the consolidator 22 is shorter than the transport path between the automatic checkout safe 24 and the rack 20 and is shorter than the transport path between the automatic checkout safe 24 and the consolidator 22. Hence, the time interval is stipulated and preset on the basis of the further transport path.

When the bill transport container has been filled in the consolidator 22, the control unit 36 sets the first transport mode I. If the bill transport container is transported directly to the automatic checkout safe 24, the first transport mode I remains set so long as the bill transport container is held in the automatic checkout safe 24, where the safe mode is then activated. If the bill transport container is first of all temporarily stored in the rack 20, on the other hand, then the control unit 36 activates the rack mode of operation. When the bill transport container is removed from the rack 20 for transport to the automatic checkout safe 24, the control unit 36 then activates the second transport mode II.

The various modes of operation described previously are each set automatically by the control unit 36 on the basis of the stored origin data. If the bill transport container was last held in the rack 20 and previously held in the automatic checkout safe 24, the control unit 36 ascertains that the bill transport container is next being transported to the consolidator 22. Therefore, the control unit 36 sets the second transport mode II during transport and sets the deactivated mode of operation following the conclusion of the transport.

On the other hand, if the result of the origin data is that the bill transport container was last held in the consolidator 22 and previously held in the rack 20 or the automatic checkout safe 24, the control unit 36 automatically sets the first transport mode I during transport, since it has ascertained that the bill transport container is next being transported to the rack 20 or to the automatic checkout safe 24. The same applies when the bill transport container was last held in the automatic checkout safe 24 and previously held in the rack 20 or the consolidator 22. In both cases, the control unit 36 likewise sets the first transport mode I.

In one alternative embodiment of the invention, not only the origin data but also destination data are stored in the memory element 40 of the cash box 30, with the control unit 36 taking into consideration not only the origin data but also the destination data when setting the modes of operation. The destination data contain particularly information about the apparatus which is intended to hold the cash box 30 next. The destination data are transmitted particularly to the cash box 30 while the latter is held in an apparatus for handling bills and are then stored in the memory element 40.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. An apparatus for temporarily storing at least one bill transport container, having at least one holding compartment for holding the bill transport container, wherein the bill transport container comprises a cancellation unit for invalidating bills held in the bill transport container and a control unit having a timer, which control unit triggers the cancellation unit after a preset time interval, wherein a control unit of the apparatus and the control unit of the bill transport container have a data transmission link set up therebetween when the bill transport container is arranged in the holding compartment, and wherein the data transmission link is used to transmit data for setting the timer from the control unit of the apparatus to the control unit of the bill transport container.

2. The apparatus as claimed in claim 1, wherein the apparatus comprises a plurality of holding compartments which are each used to hold at least one bill transport container.

3. The apparatus as claimed in claim 1, wherein the data transmission link is a wireless or a wired data transmission link.

4. The apparatus as claimed in claim 1, wherein the data transmission link is formed by means of a plug connection.

5. The apparatus as claimed in claim 1, wherein the control unit of the apparatus stops the timer when the bill transport container is inserted into the holding compartment and restarts the timer with the remaining time which the timer still had upon insertion when said bill transport container is removed from the holding compartment.

6. The apparatus as claimed in claim 1, wherein the control unit of the apparatus deactivates the timer when the bill transport container is inserted into the holding compartment and restarts the timer with the preset time interval when said value transport container is removed from the holding compartment.

7. The apparatus as claimed in claim 1, wherein the control unit of the apparatus deactivates the timer when the bill transport container is inserted into the holding compartment and restarts the timer with a further time interval, which is different than the one preset time interval, when said bill transport container is removed from the holding compartment.

8. The apparatus as claimed in claim 7, wherein the control unit of the apparatus stipulates the value of the further time interval on the basis of the location to which the bill transport container is intended to be transported following removal from the apparatus.

9. The apparatus as claimed in claim 1, wherein the control unit of the apparatus sets a mode of operation for the bill transport container, particularly sets an activated mode of operation, in which the control unit triggers the cancellation unit when a manipulation sensor has detected a manipulation attempt, or sets a deactivated mode of operation, in which the control unit does not trigger the cancellation unit when a manipulation sensor has detected a manipulation attempt.

10. The apparatus as claimed in claim 1, wherein the apparatus is arranged in a vehicle.

11. The apparatus as claimed in claim 1, wherein the apparatus is arranged in a building.

12. The apparatus as claimed in claim 1, wherein the apparatus is manually portable.

13. The apparatus as claimed in claim 1, wherein the apparatus and the bill transport container held in the holding compartment have a power supply connection formed therebetween for supplying the bill transport container with electric power.

14. The apparatus as claimed in claim 1, wherein the data transmission link is used to transmit data having information about the stock of bills in the bill transport container, manipulation attempts, the place of origin of the bill transport container, the destination of the bill transport container, handover locations of the bill transport container and/or handover times of the bill transport container.

15. The bill transport container as claimed in claim 1, wherein the bill transport container is in the form of a cash box.

16. The bill transport container as claimed in claim 1, wherein the bill transport container comprises a drum module for storing bills or at least one holding compartment for storing bills in stacked form.

17. A bill transport container, having a cancellation unit for invalidating bills held in the bill transport container, and having a control unit which triggers the cancellation unit after a preset time interval, wherein in a first mode of operation the control unit triggers the cancellation unit after a first preset time interval, in a second mode of operation the control unit triggers the cancellation unit after a second preset time interval, a memory area of a memory element stores origin data having information about the last two apparatuses for handling bills which last held the bill transport container, and wherein the control unit sets the mode of operation on the basis of the origin data.

18. The bill transport container as claimed in claim 17, wherein a memory area of the memory element stores destination data having information about the apparatus for handling bills to which the bill transport container is intended to be transported next, and in that the control unit sets the mode of operation on the basis of the destination data.

19. The bill transport container as claimed in claim 17, wherein the container is configured to be received by a compartment in a rack.

20. The bill transport container as claimed in claim 17, wherein the control unit sets a third mode of operation when the bill transport container is arranged in an automated teller machine, an automatic checkout system or an automatic checkout safe, and in that in the third mode of operation the control unit triggers the cancellation unit when a manipulation sensor has detected a manipulation attempt.

21. Apparatus for transporting financial documents, comprising:

a document transport container for holding the financial documents, the container having a cancellation unit, a control unit and a timer for triggering the cancellation unit;

a rack having a compartment for receiving the container, the rack having a control unit;

a data transmission link between the control units of the container and the rack that is established when the container is inserted into the compartment; and wherein the link transmits data to the timer to control the triggering of the cancellation unit.

* * * * *